US007155940B1

(12) United States Patent
Imboden et al.

(10) Patent No.: US 7,155,940 B1
(45) Date of Patent: Jan. 2, 2007

(54) THREE-PIECE PANTY GARMENT AND METHODS OF MAKING

(75) Inventors: Walter H. Imboden, Burlington, NC (US); Ronald Wayne Brown, Rural Hall, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 11/376,008

(22) Filed: Mar. 15, 2006

Related U.S. Application Data

(60) Provisional application No. 60/661,845, filed on Mar. 15, 2005.

(51) Int. Cl.
*D04B 1/24* (2006.01)

(52) U.S. Cl. ..... 66/8; 66/177

(58) Field of Classification Search ..... 66/177, 66/8, 169 R, 170, 171, 175
See application file for complete search history.

(56) References Cited

U.S. PATENT DOCUMENTS 3,739,398 A * 6/1973 Sarmiento ..... 2/407
3,985,004 A 10/1976 Johnson et al.
4,043,156 A * 8/1977 Pernick ..... 66/177
4,527,403 A * 7/1985 Fullbright et al. ..... 66/177
4,682,479 A * 7/1987 Pernick ..... 66/176
4,722,202 A 2/1988 Imboden
5,181,278 A * 1/1993 Peleg et al. ..... 2/402
6,055,674 A * 5/2000 Imboden et al. ..... 66/177
6,192,717 B1 * 2/2001 Rabinowicz ..... 66/177
6,622,312 B1 * 9/2003 Rabinowicz ..... 2/401
6,968,714 B1 * 11/2005 Sangiacomo ..... 66/177
2005/0193777 A1 * 9/2005 Sangiacomo ..... 66/8

FOREIGN PATENT DOCUMENTS

EP 0516905 * 12/1992 ..... 66/177

* cited by examiner

*Primary Examiner*—Danny Worrell
(74) *Attorney, Agent, or Firm*—Kilpatrick Stockton LLP

(57) ABSTRACT

A three-piece panty garment can include three panels formed from halves of tubular blanks knit on a small-diameter circular knitting machine designed for making pantyhose. As a result, such a panty garment can comprise a girth that is substantially three times the diameter of a small-diameter circular knitting machine knitting cylinder. Such panty garments and methods of making such panty garments can provide larger size panty garments, for example, size 10, 12, and 14, made on a circular knitting machine designed for making pantyhose.

26 Claims, 9 Drawing Sheets

THREE-PIECE PANTY GARMENT AND METHODS OF MAKING

CROSS-REFERENCE TO RELATED APLICATIONS

This application claims priority to co-pending U.S. Provisional Patent Application No. 60/661,845, filed Mar. 15, 2005, which is incorporated by reference herein in its entirety.

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates to garments and, in particular, to a three-piece panty garment and methods of making such a garment. Embodiments of the present invention are advantageous for providing panty garments in larger sizes.

BACKGROUND OF THE INVENTION

A common method for manufacturing a panty garment involves first knitting a tubular blank. Then, leg openings are cut out on opposite sides of the tube. The tube is slit lengthwise above and below one of the leg opening cut-outs to provide a flat blank in which the left side and right side lengthwise are mirror images. The top and bottom of the blank are folded over onto each other and the sides are sewn together to form a typical panty garment having a waist and two leg openings.

This approach to manufacture of panty garments involves knitting a tubular blank on a circular knitting machine having a knitting cylinder with a particular diameter. The knitted tubular blank has a width in its relaxed, unstretched state equivalent to the diameter of the knitting cylinder. Slitting the knitted tube provides a blank having a width that is twice the diameter of the circular tube. Thus, the girth of a panty garment made from such a blank is limited to essentially twice the diameter of the circular knitting machine cylinder from which the tubular blank is made.

Tubular blanks for making panty garments can be knit on circular knitting machines designed for knitting pantyhose. It is desirable to manufacture panty garments from circular knitting machines designed for knitting pantyhose because such manufacture permits utilization of knitting machines that are underutilized or are not in use due to decreased demand for pantyhose. Knitting cylinders on circular knitting machines for knitting pantyhose are relatively small, the cylinders being sized to provide a tubular blank for one leg of a pantyhose garment. As a result, a tubular blank knit on a circular knitting machine designed for knitting pantyhose does not have a diameter large enough to make larger size panty garments.

Thus, there is a need to provide a larger size panty garment made from a circular knitting machine designed for knitting pantyhose. There is also a need for methods for making a larger size panty garment made from a circular knitting machine designed for knitting pantyhose.

SUMMARY OF THE INVENTION

The present invention provides embodiments of a three-piece panty garment. In one such embodiment, the panty garment can comprise a front panel and two back panels, each panel formed from half of a tubular blank knit on a small-diameter circular knitting machine. In an embodiment, the front panel can be formed from a first tubular blank and the two back panels can be formed from a second tubular blank. The panty garment includes a crotch portion integrally knit with the front panel, a waistband at the top of the front and back panels, and two leg openings. A lengthwise front seam extending between the waistband and one of the leg openings can join each side of the front panel and one of the back panels. A lengthwise rear seam extending between the waistband and the crotch portion can join the two back panels. A rear crotch seam extending transversely between the leg openings can join the bottoms of the two back panels with the bottom of the front panel. Such a panty garment formed from three "half-blanks" of a tubular blank can comprise a girth substantially three times the diameter of the knitting cylinder. In this manner, a panty garment having larger sizes, for example, size 10, 12, and 14, can be formed from tubular blanks knit on a circular knitting machine designed for making pantyhose.

The present invention provides embodiments of methods of making such a three-piece panty garment. For example, one illustrative method comprises knitting at least two tubular blanks on a small-diameter circular knitting machine and making cut-outs for leg openings at predetermined locations about the circumference of the tubular blanks. The tubular blanks can be slit lengthwise to form a front panel from one tubular blank and two back panels from another tubular blank. A lengthwise front seam extending between a waistband and one of the leg openings can be sewn to join each side of the front panel and one of the back panels. Likewise, a lengthwise rear seam extending between the waistband and a crotch portion can be sewn to join the two back panels. A transverse rear crotch seam extending between the leg openings can be sewn to join the bottoms of the two back panels with the bottom of the front panel. In this way, a panty garment having larger sizes, for example, size 10, 12, and 14, can be made from tubular blanks knit on a circular knitting machine designed for making pantyhose.

Features of a three-piece panty garment and methods of making such a garment of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A three-piece panty garment and methods of making such a garment of the present invention provides numerous advantages over prior underwear garments. For example, the present invention advantageously provides a panty garment made from tubular blanks knit on conventional circular knitting machines designed for making pantyhose. This improves manufacturing productivity by allowing utilization of otherwise under-utilized or unused knitting machines.

Another advantage is that the present invention provides a large-sized panty garment made from tubular blanks knit on conventional circular knitting machines designed for making pantyhose.

Another advantage is that the present invention provides a large-sized panty garment having advantageously short, front-placed seams from the waistband to the leg openings.

Another advantage is that the present invention provides a panty garment having the crotch integrally knit with the front panel. Because the crotch is integrally knit with the center panel half-blank, there is no crotch seam in the front at the junction of the crotch and front panel, thus providing increased comfort.

Another advantage is that the present invention provides a large size panty garment in which cotton or other desirable yarn can be knit directly into the crotch. The cotton yarns can be knit into the crotch and biased toward the inside of the garment for increased comfort and absorbency.

Another advantage is that the present invention provides a large size panty garment having a mid-line seam located in the center of the back of the garment. Such mid-line rear seam placement allows the seam to fit comfortably and to be positioned in the anatomical groove between a wearer's buttocks with a decreased likelihood of showing through clothing.

Another advantage is that the present invention provides a means for making various sizes of panty garment on the same size knitting machine cylinder by tightening or loosening tension on the yarn as it is knit.

As will be realized by those of skill in the art, many different embodiments of a three-piece panty garment and methods of making such a garment according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

In embodiments of the present invention, a panty garment can comprise a plurality of half-blanks formed from tubular blanks knit on a small-diameter circular knitting machine. The half-blanks can be formed by slitting a plurality of circularly knit tubular blanks in half lengthwise. Various numbers of the half-blanks can be sewn together to form various sized panty garments. FIGS. 1–13 show such embodiments.

Figure 1:
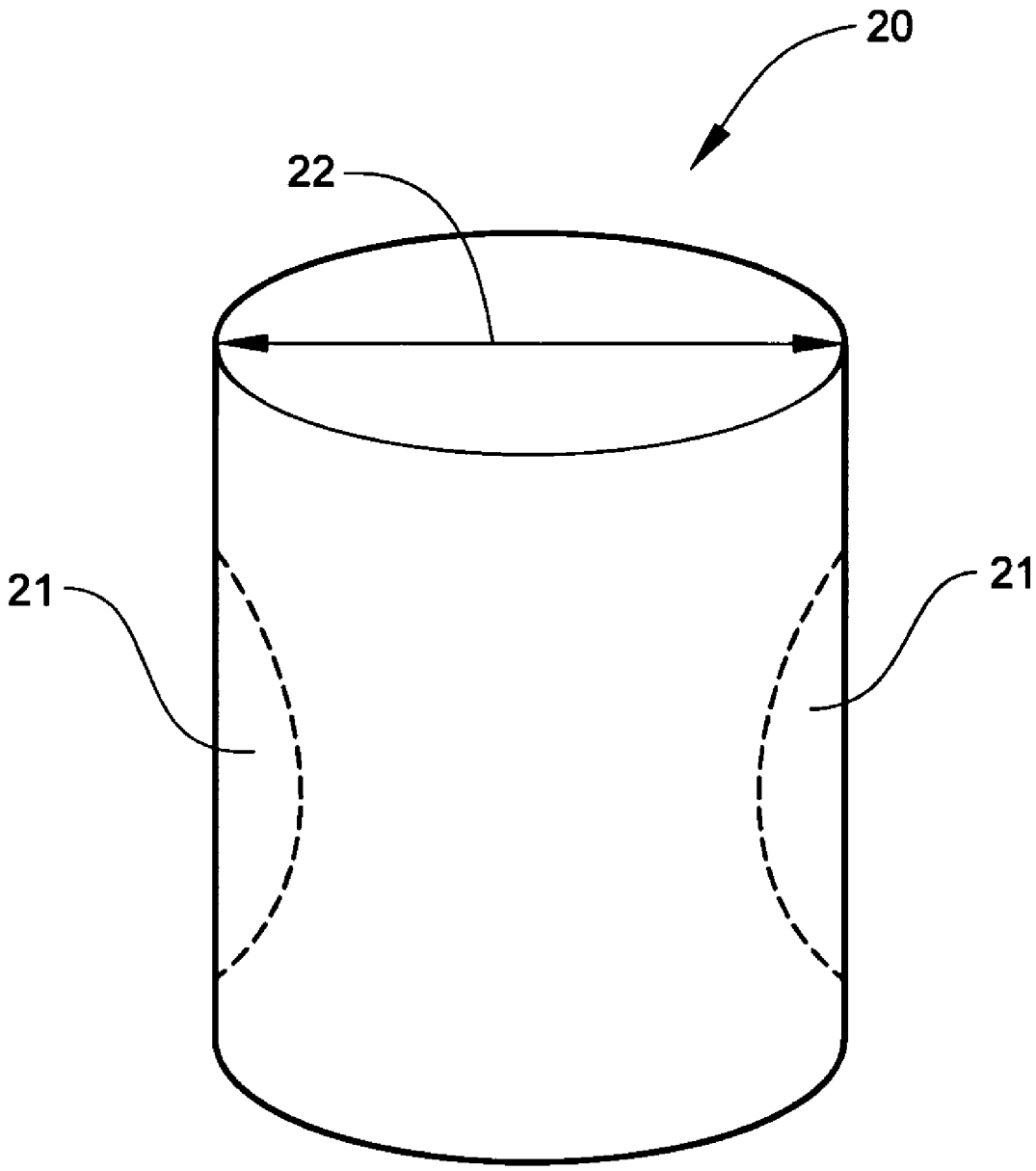
FIG. 1 is a diagrammatic view of a tubular knit blank useful in an embodiment of the present invention.

In one illustrative embodiment, as shown in FIGS. 1–5, a three-piece panty garment 10 can include three half-blanks 11, 12, 13 formed from tubular blanks 20 knit on a small-diameter circular knitting machine designed for making pantyhose. FIG. 1 illustrates an embodiment of a single tubular knit blank 20 that can have cut-outs 21, for example, cut-outs 21 for leg openings, at one or more predetermined locations about the circumference of the blank 20 and slit lengthwise to provide two half-blanks. Such half-blanks are useful for making larger size panty garments 10 as in embodiments of the present invention. The diameter 22 of the tubular blank 20 in its relaxed, unstretched state is limited to approximately the diameter of the knitting cylinder from which the blank 20 is made. While the embodiments shown illustrate the panty garment 10 formed from three half-blanks 11, 12, 13, panty garments 10 according to the present invention can include two half-blanks or more than three half-blanks, depending on the desired size of the finished panty garment 10.

Figure 2:
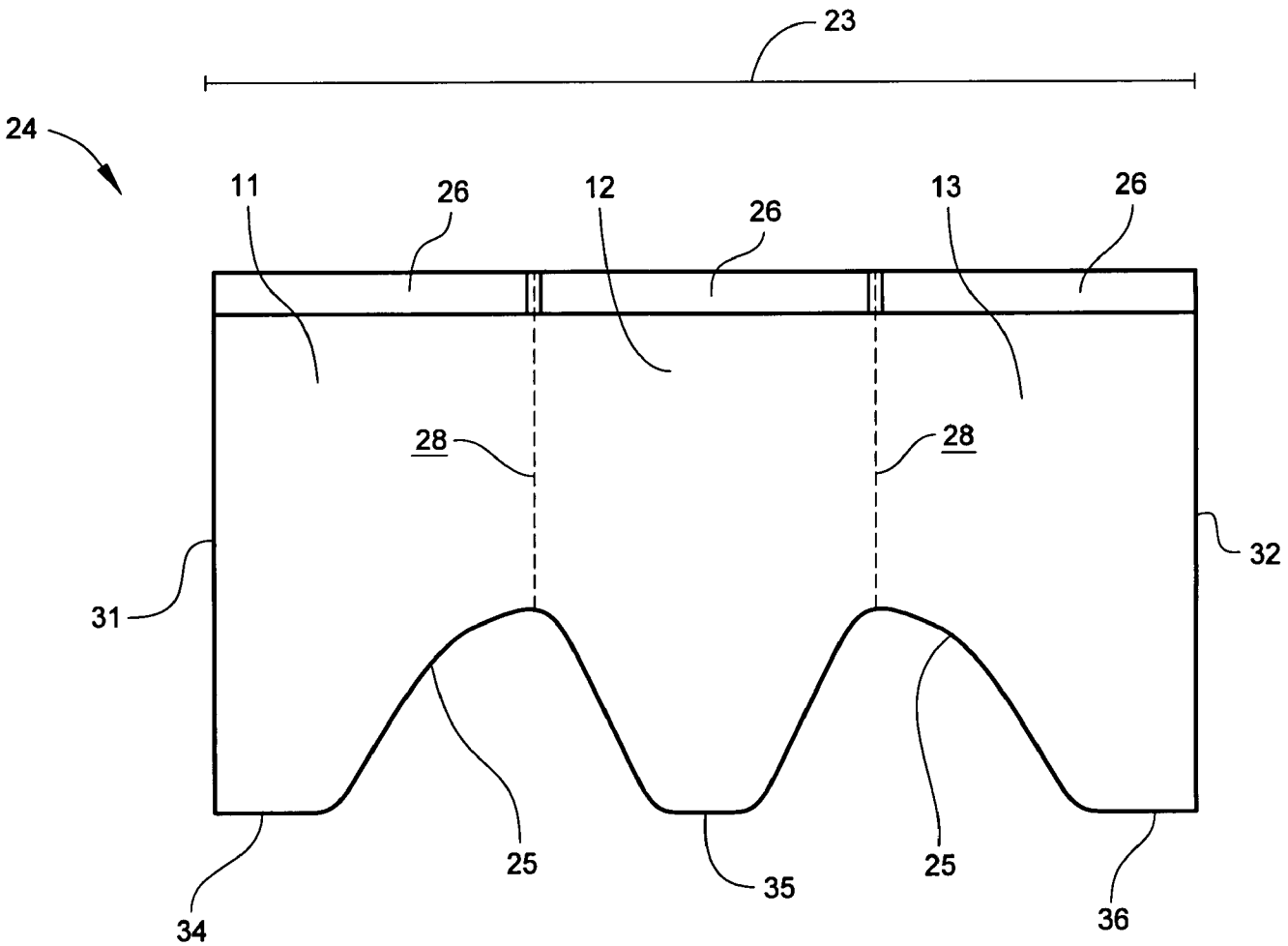
FIG. 2 is a diagrammatic view of three half-blanks of the tubular knit blank shown in FIG. 1 laid out for sewing together in an embodiment of a three-piece panty garment of the present invention.
Figure 3:
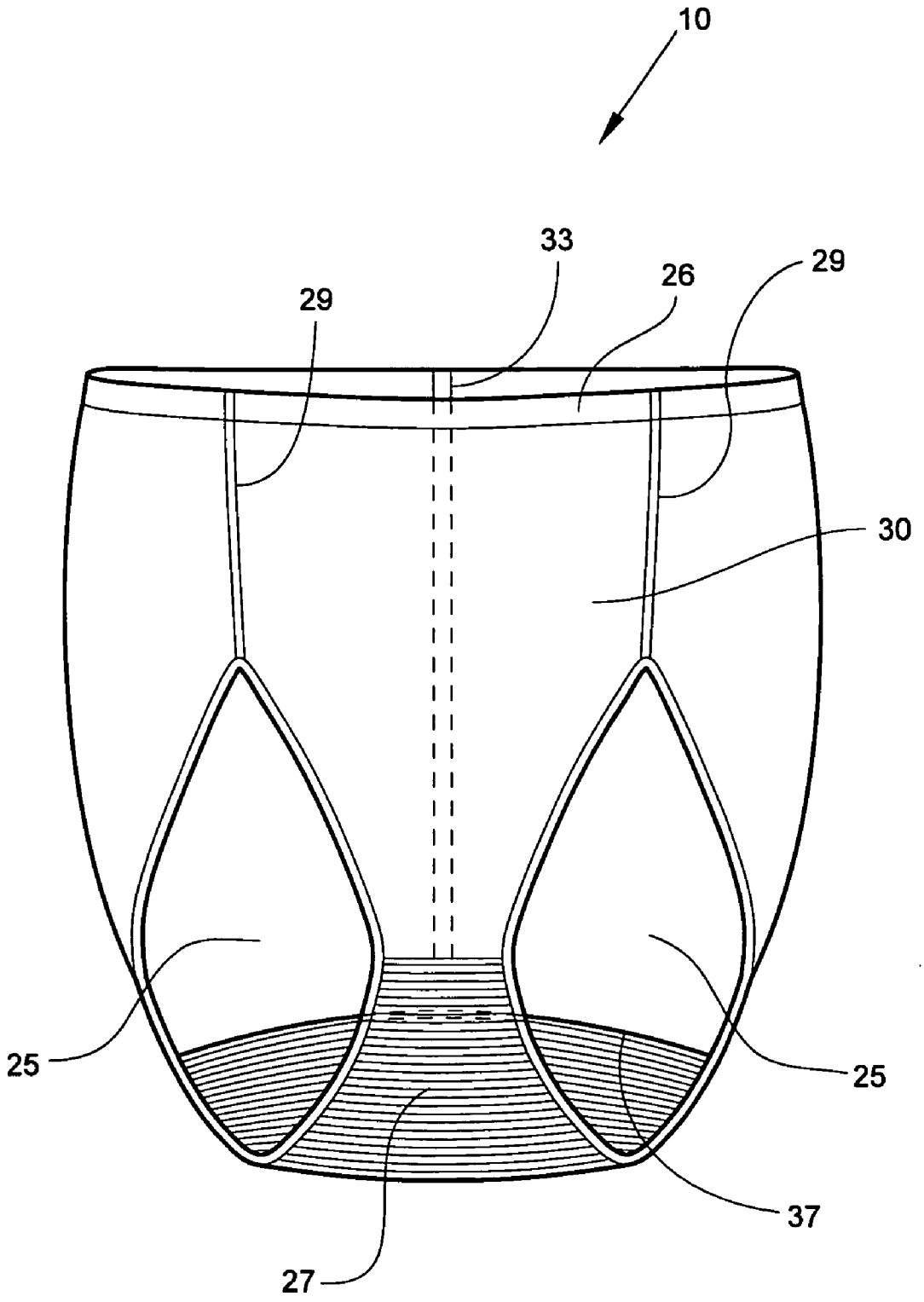
FIG. 3 is a view of a finished three-piece panty garment in an embodiment of the present invention.

In the embodiment shown in FIGS. 2 and 3, the three-piece panty garment 10 can include three separate half-blanks, or panels, 11, 12, 13 formed from tubular knit blanks 20 that are slit and sewn together to make a larger size panty garment 10. As a result, the circumference, or girth, 23 of a such panty garment 10 can be three times the diameter of a circular knitting machine cylinder designed for making pantyhose. Girth of a garment is defined for purposes herein as the effective circumference of the garment in its relaxed state in which yarn is not being stretched in a coursewise direction.

As shown in the embodiment in FIGS. 2 and 3, three half-blank panels 11, 12, 13 slit lengthwise from two tubular blanks similar to the tubular blank 20 shown in FIG. 1 are placed side-by-side to form a panty garment blank 24. Cut-outs 21 can be made specifically for the three-piece panty garment 10 such that the leg openings 25 from a first half-blank 11, a second half-blank 12, and a third half-blank 13 can be aligned as shown in FIG. 2. In an embodiment, cut-outs 21 can be made only on one side of the tubular blank 20 so that the uncut side can form the circumferential waistband 26 when the half-blanks 11, 12, 13 are aligned. The cut-outs 21 can be shaped in any configuration suitable for the opening to be created, for example, a leg opening 25. The outer half-blanks, or two back panels, (first half-blank 11 and third half-blank 13) can be mirror images of each other and can be formed from one tubular blank 20. The middle half-blank, or front panel, 12 can be formed from another tubular blank 20 with a leg opening cut out 21 on only one side and in such a manner as to provide sufficient material for forming a crotch 27 on the cut side. The middle half-blank panel 12 can be referred to as the front panel 12, as in the three-piece panty garment 10, the middle panel 12 comprises the front portion 30 of the garment 10. The two outer half-blank panels 11, 13 may also be referred to as back panels 11, 13, as in the three-piece panty garment 10, the two outer panels 11, 13 form the back portion of the garment 10, though the back panels 11, 13 also form a small part of the front portion 30 of the garment 10. Overlapping edges 28, or sides, of the first half-blank 11 and the second half-blank 12 can be sewn together along the dotted line as shown in FIG. 2 to form a front seam 29 extending from the waistband 26 to the leg opening 25. Overlapping edges 28, or sides, of the second half-blank 12 and the third half-blank 13 can be sewn together along the opposite side dotted line to form another front seam 29 from the waistband 26 to the leg opening 25. Leg openings 25 are often skewed toward the front 30 of a panty garment 10 due to the desire for a greater amount of fabric on the back than on the front 30 of the garment 10 for purposes of fashion and comfort. In an embodiment, the front seams 29 can extend from the waistband 26 to the topmost portion of the arch of the leg openings 25 on either side of the front portion 30 of the panty garment 10. As a result, the two front seams 29 are thus desirably located so as to be the shortest possible length.

A first side 31 of the panty garment blank 24 can be moved to overlap a second side 32 of the panty garment blank 24, and the overlapping first and second sides 31, 32 can then be sewn together to form a lengthwise rear seam 33 extending downward from the waistband 26. To form the crotch 27 of the panty garment 10, a bottom edge 34 of the first half-blank 11 and a bottom edge 36 of the third half-blank 13 can each be overlapped with a portion of a bottom edge 35 of the second half-blank 12. The overlapped bottom edges 34, 36 of the first and third half-blanks 11, 13 with the bottom edge 35 of the second half-blank 12 can then be sewn together to form the rear crotch seam 37. The moving together of the bottom edges 34, 35, 36 of the three half-blanks 11, 12, 13 and sewing the overlapping edges thereof as described also forms the leg openings 25 of the panty garment 10. The rear crotch seam 37, as shown in FIG. 3, extends transversely from one leg opening 25 to the other across the back of the panty garment 10. Accordingly, an embodiment of the present invention can provide a three-piece panty garment 10 including three half-blanks 11, 12, 13 of tubular blanks 20 knit on a small-diameter circular knitting machine designed for making pantyhose.

Figure 4:
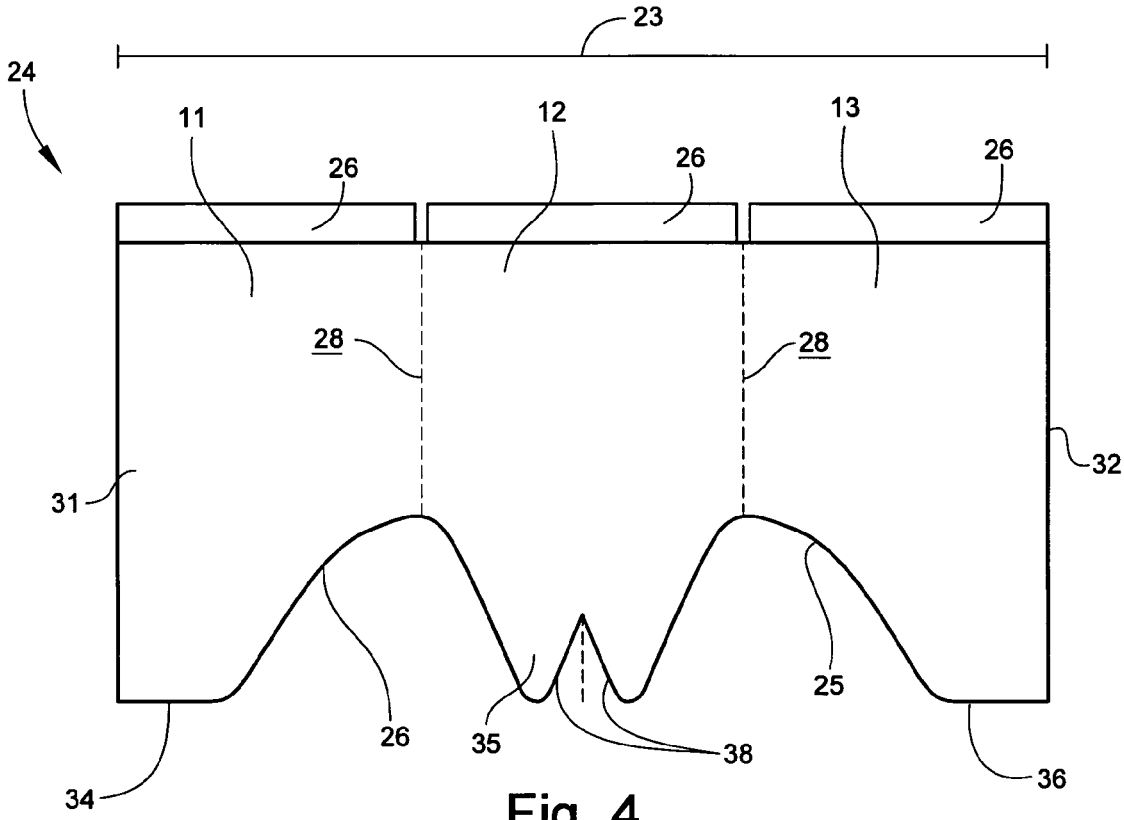
FIG. 4 is a diagrammatic view of three half-blanks, the middle half-blank having a Y-seam, laid out for sewing together in another embodiment of a three-piece panty garment of the present invention.
Figure 5:
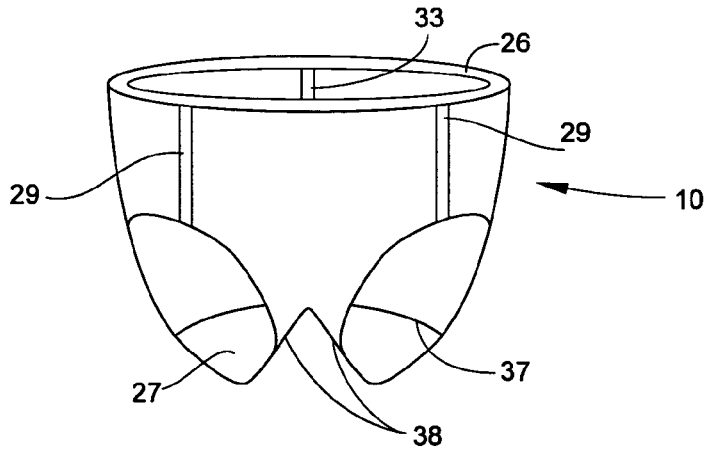
FIG. 5 is a view of an embodiment of a finished three-piece panty garment having a Y-seam formed from the three half-blanks shown in FIG. 4.

FIGS. 4 and 5 show another embodiment of a three-piece panty garment 10 according to the present invention. As in the embodiment shown in FIGS. 2 and 3, three tubular half-blanks 11, 12, 13 slit lengthwise from two tubular blanks similar to the tubular blank 20 shown in FIG. 1 are placed side-by-side. Cut-outs 21 can be made specifically for a three-piece panty garment 10 such that the leg openings 25 from a first half-blank 11, a second half-blank 12, and a third half-blank 13 can be aligned as shown in FIG. 4. In an embodiment, cut-outs 21 can be made only on one side of the tubular blank 20 so that the uncut side can form the circumferential waistband 26 when the half-blanks panels 11, 12, 13 are aligned. The cut-outs 21 can be shaped in any configuration suitable for the opening to be created, for example, a low-rise or a high-rise leg opening 25. The outer half-blanks, or two back panels, (first half-blank 11 and third half-blank 13) can be mirror images of each other and can be formed from one tubular blank 20. The middle half-blank, or front panel, 12 can be formed from another tubular blank 20 with a leg opening cut out 21 on only one side and in such a manner as to provide sufficient material for forming the crotch 27 on the cut side. Overlapping edges 28 of the first half-blank 11 and the second half-blank 12 can be sewn together along the dotted line as shown in FIG. 4 to form a front seam 29 from the waistband 26 to the leg opening 25. Overlapping edges 28 of the second half-blank 12 and the third half-blank 13 can be sewn together along the opposite side dotted line to form another front seam 29 extending from the waistband 26 to the leg opening 25. In an embodiment, the front seams 29 can extend from the waistband 26 to the topmost portion of the arch of the leg openings 25 on each side of the front portion 30 of the panty garment 10. A first side 31 of the panty garment blank 24 can be moved to overlap a second side 32 of the panty garment blank 24, and the overlapping first and second sides 31, 32 can then be sewn together to form a lengthwise rear seam 33 extending downward from the waistband 26.

To form the crotch 27 of the panty garment 10, the bottom edge 34 of the first half-blank 11 and the bottom edge 36 of the third half-blank 13 can each be overlapped with a portion of the bottom edge 35 of the second half-blank 12. The overlapped bottom edges 34, 36 of the first and third half-blanks 11, 13 with the bottom edge 35 of the second half-blank 12 can then be sewn together to form the rear crotch seam 37. The moving together of the bottom edges 34, 35, 36 of the three half-blanks 11, 12, 13 and sewing the overlapping edges thereof as described also forms the leg openings 25 of the panty garment 10. The rear crotch seam 37 extends transversely from one leg opening 25 to the other across the back of the panty garment 10. In this embodiment, the crotch 27 includes a Y-seam 38 as may be used, for example, in conventional pantyhose. The Y-seam 38 can be formed by slitting lengthwise the bottom portion of the second, or front, half-blank panel 12 for a predetermined length and sewing the edges of the lengthwise slit together. Each edge of the bottom portion of the front half-blank panel 12 thus formed can then be sewn along the bottom edge 34, 36 of the adjacent half-blank 11, 13. In this manner, a Y-shaped seam 38 can be formed in the crotch 27 of the three-piece panty garment 10 according to the present invention.

In an embodiment of the present invention, the same size knitting cylinder of a circular knitting machine (not shown) can be used to make tubular blanks 20 useful for manufacturing various sizes of panty garments 10. A small-diameter circular knitting machine can have a knitting cylinder of, for example, four inches or eight inches. Such knitting machines can have a single cylinder, double cylinder, cylinder and dial, or other configuration for producing a tubular blank 20. Tubular blanks 20 useful for forming half-blanks 11, 12, 13 for various size panty garments 10 can be modified on the same knitting cylinder by changing the tension on the yarn as it is knit into the blank 20. The width of half of a knitting cylinder is equivalent to the diameter of the cylinder. Three half-blank panels 11, 12, 13 formed from tubular blanks 20 knit on a four-inch knitting cylinder comprise three diameters of the cylinder. Three half-blank panels 11, 12, 13 having such diameters that are sewn together in an embodiment of the present invention can provide panty sizes 10, 12, and 14, or larger or smaller. Panty size 10 accommodates a hip girth of 48 inches. Panty size 12 accommodates a hip girth of 56 inches. Panty size 14 accommodates a hip girth of 64 inches. As an example, three half-blanks 11, 12, 13 formed from tubular blanks 20 knit at a predetermined tension on a four-inch circular knitting machine can be slit lengthwise and sewn together to form a size 10 panty.

To make a size 12 panty, three half-blanks 11, 12, 13 can be formed from tubular blanks 20 made on the same four-inch circular knitting machine knitting cylinder as the tubular blanks 20 from which the three half-blanks 11, 12, 13 for the size 10 panty garment 10 are knit. However, for the three half-blanks 11, 12, 13 to be used for a size 12 panty garment 10, the tubular blanks 20 are knit more loosely with less tension on the yarn (resulting in greater distance between courses and/or wales) than for the tubular blanks 20 from which the three half-blanks 11, 12, 13 to be used for a size 10 panty garment 10. Likewise, to make a size 14 panty 10, three half-blanks 11, 1, 2, 13 can be formed from tubular blanks 20 knit on the same four-inch circular knitting machine knitting cylinder as the tubular blanks 20 from which the three half-blanks 11, 12, 13 for the size 10 and 12 panty garments 20 are knit. For the three half-blanks 11, 12, 13 to be used for a size 14 panty garment 10, the tubular blanks 20 are knit more loosely and with less tension on the yarn than for the tubular blanks 20 from which the three half-blanks 11, 12, 13 to be used for a size 12 panty garment 10.

In embodiments, three half-blanks 11, 12, 13 formed from tubular blanks 20 knit on the same small-diameter knitting cylinder as the tubular blanks 20 for larger size (size 10, 12, 14, and larger) panty garments 10 can be utilized to make panty garments 10 smaller than size 10. In such embodiments, tension on the yarn is increased significantly as it is knit so that the resulting fabric has a tighter knit structure relative to the tubular blanks 20 from which the three half-blanks 11, 12, 13 for a size 10 panty garment 10 are formed. In addition to having a smaller size, such a panty garment 10 having a tighter knit structure would also exhibit greater durability.

Embodiments of a panty garment 10 of the present invention manufactured from multiple tubular blanks 20 knit on a small-diameter circular knitting machine designed for making pantyhose can include desired patterning. Such patterning can be programmed in the knitting machine.

Panty garments 10 of the present invention can include a turned waistband 26, as shown in FIGS. 2 and 4. The turned waistband 26 can be sewn after the first, second, and third half-blanks 11, 12, 13 are sewn together to form the three-piece panty garment 10. Alternatively, a separate waistband 26, for example, a waistband 26 comprising elastic yarn, can be sewn onto the top of the three-piece panty garment 10 after it is formed. Panty garments 10 of the present invention can include leg openings 25 having a thin band of elastic sewn around the edges of the leg openings 25. In an embodiment, other conventional leg bands can be applied to the edges of the leg openings 25.

In an embodiment, the crotch portion 27 of a half-blank 11, 12, 13 may be knit with the same yarn as the remainder, or body portion, of the panty garment 10. For example, the crotch portion 27 may be knit with nylon, or with cotton as shown in FIG. 3. Cotton yarns can be knit into the crotch portion 27 and biased toward the inside of the garment 10 for increased comfort and absorbency. In an embodiment, the crotch portion 27 may be knit with the same or a different stitch as in the body portion. For example, alternate courses of the crotch portion 27 may float across several loops, and the floats may be in line with one another to form a ribbed look, be uniformly staggered in a zig-zag pattern to produce a waffle effect, or the floats may be in a random pattern, depending upon the look to be achieved at the crotch portion 27.

Figure 6:
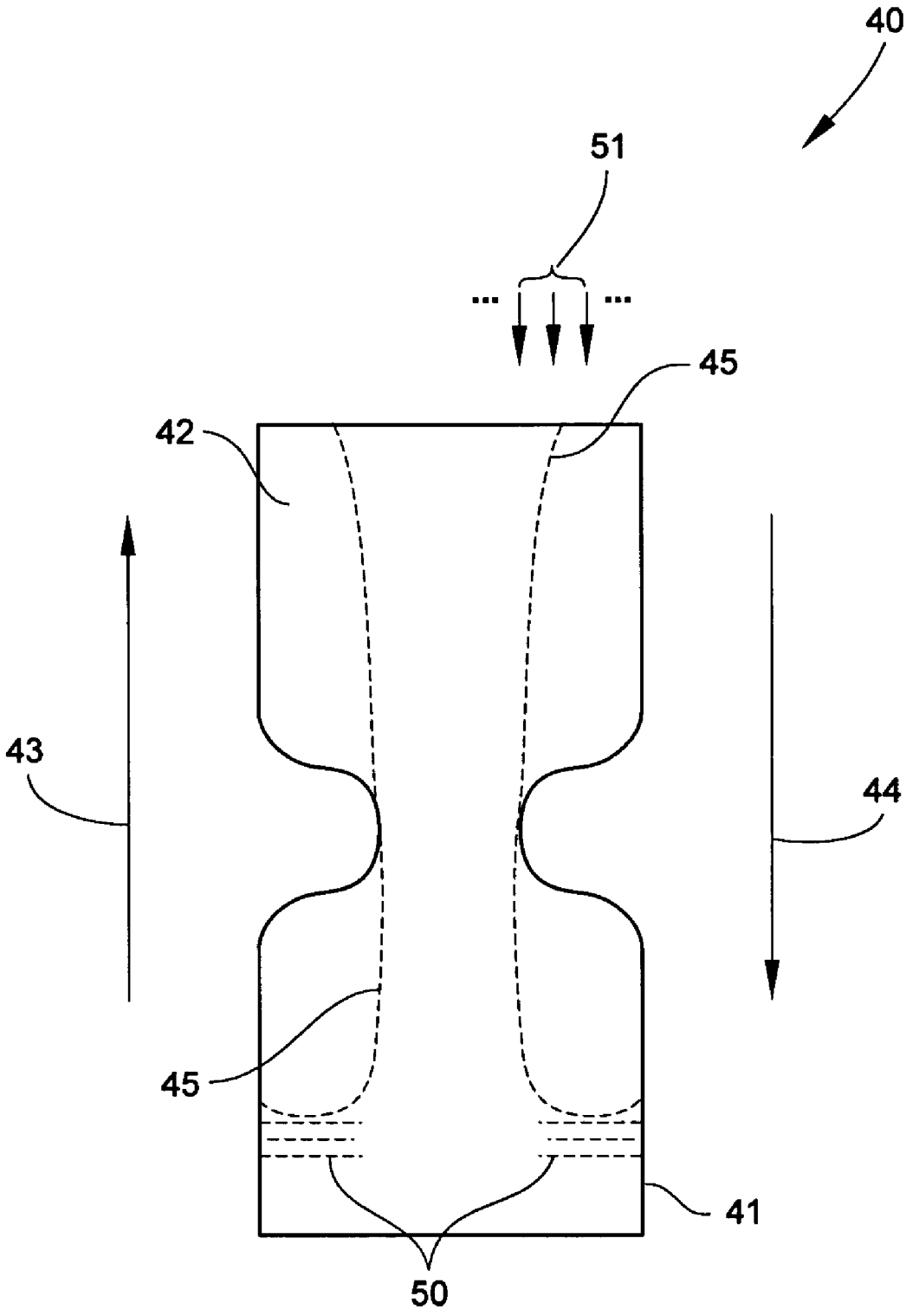
FIG. 6 is a diagrammatic view of a one-piece underwear garment blank in an embodiment of the present invention.

Embodiments of a three-piece panty garment 10 of the present invention can include features for preventing runs, as shown in FIG. 6. In such an embodiment, a tubular blank 20 for forming a three-piece panty garment 10 can be made by knitting a tubular hourglass-shaped blank 40 starting with a body portion of constant diameter, then a tapered portion of gradually diminishing diameter, next a crotch portion of generally uniform but smaller diameter than the body portion, next a tapered portion of gradually increasing diameter similar to the first tapered portion but substantially a mirror image thereof, and finally a second body portion of generally uniform diameter. The tubular blank 40 can next be slit longitudinally (walewise) to form a flat blank.

In manufacture of many types of panty garments 10, the area cut out 21 for leg openings in the back portions 42 of the garment 10 is less than the area cut out 21 for leg openings 25 in the front portions 41 of the garment 10. Such a design leaves more fabric in the back portion than in the front portion 41 for greater coverage of the buttocks region. This design is due to the human anatomy in the front lower torso and buttocks regions, particularly the female anatomy in these regions, and because of underwear fashions. When the leg portions are cut out of the front 41 of a panty garment 10, either manually by an operator or in an automated process, cuts are made generally across wales 51. Cutting across wales 51 can create loose ends of yarn, which can then create a "run" in the finished panty garment 10.

After front and back leg openings 25 are cut out, a welt can be sewn around the cut edges of the leg openings 25. When a welt is sewn across wales 51 around the leg openings 25, particularly in the front portion 41 leg openings 25, there is a risk that loose yarn ends can run during the sewing process. Embodiments of the present invention provides means and methods for reducing and preventing such runs in knitted panty garments 10.

Often, knitting in a panty garment proceeds from the front 41 to the back 42 in a front-to-back knitting 43 process. In one aspect of the present invention, as shown in FIG. 6, embodiments include knitting 44 a panty garment 10 from the back 42 to the front 41 (or from the bottom to the top). Such embodiments include first knitting the back portion 42 (or bottom) of the panty garment followed by knitting the front portion 41 (or top) of the garment. Sewing marks 45 are knit into the front 41 and back 42 portions of a garment for indicating the locations for cutting out leg openings cut-outs 21 (and for sewing welts along edges of the cut-outs 21). Sewing marks 45 can be incorporated into knitting by programming stitch and/or yarn changes at pre-determined locations. In the underwear garment blank 41 shown in FIG. 6, less fabric is cut from the back portion 42 than the front portion 41 for leg openings. The angle at which the leg opening cut-outs 21 in the back portion 42 are cut is approximately parallel to the wales 51. As a consequence, fewer wales 51 are cut across when making leg openings cut-outs 21 in the back portion 42, thereby reducing, or preventing, the possibility of runs in the back portion 42 of the underwear garment 10. In addition, cutting across a minimum number of wales 51 provides a stronger seam along the edge of the leg opening cut-out 21.

In another aspect of the present invention, run-prevention stitches 50 are placed in desired courses of a knitted panty garment 10. For example, in the embodiment shown in FIG. 6, run-prevention stitches 50 can be knit adjacent to the sewing marks 45 where the front leg openings 25 are to be cut out. Run-prevention stitches 50, such as float stitches 62 and tuck stitches, can be used to stop runs in the direction of knitting, but not in the direction opposite the knitting direction. Accordingly, run-prevention stitches 50 placed downstream of the front leg opening cut-out areas 25 can prevent runs in the direction of knitting, that is, in the front portion 30 of the panty garment 10.

Embodiments of the present invention include a method for preventing runs in a knitted panty garment that may comprise knitting the panty garment 30 in one direction (for example, from front to back 43 or from back to front 44), cutting an opening in one portion (back or front) of the garment blank 20, such as a leg opening 25, across a minimum number of wales 51, or across no wales 51. Such an embodiment further includes placing run-prevention stitches 50 in courses 52 at locations downstream in the direction of knitting from an area for cutting another opening. The combination of cutting across a minimum number of wales 51, or across no wales 51, at one opening 25 and the placement of run-prevention stitches 50 downstream from the area for cutting another opening prevents runs in the direction of knitting at both openings.

Figure 8:
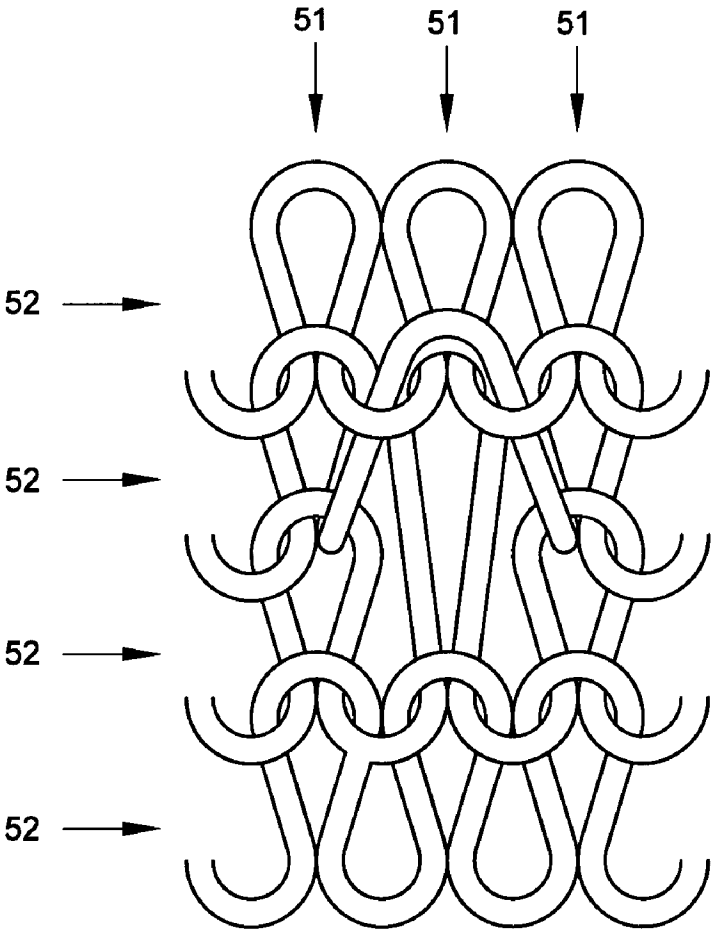
FIG. 8 is a diagrammatic view of a tuck stitch useful in an embodiment of the present invention.
Figure 7:
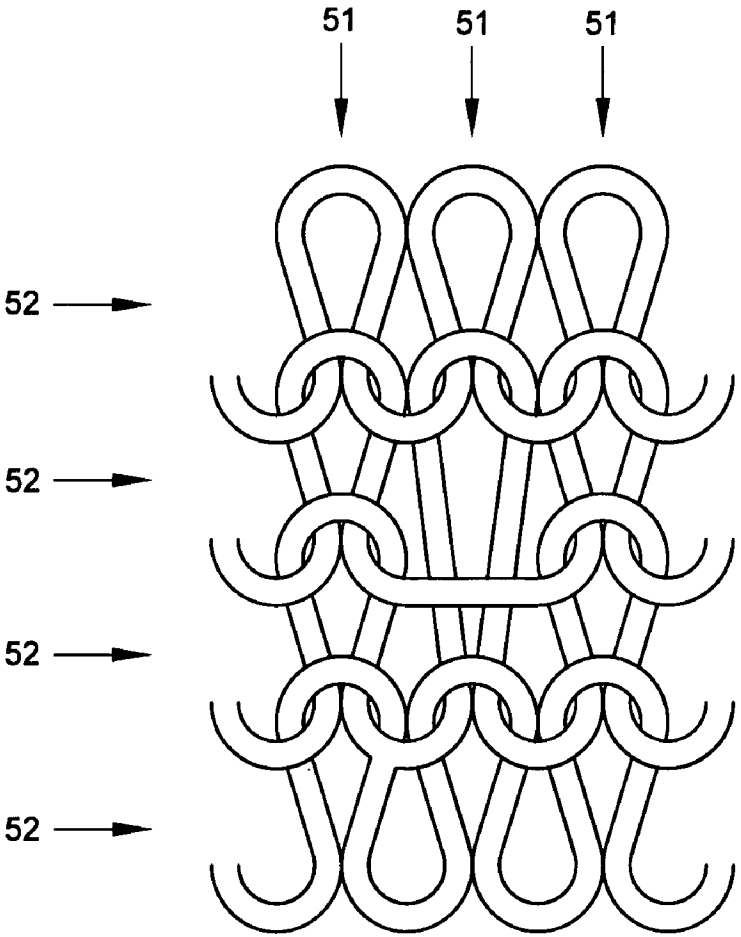
FIG. 7 is a diagrammatic view of a float stitch useful in an embodiment of the present invention.

Run-prevention stitches 50 can include, for example, float stitches 62 and tuck stitches, as shown in FIGS. 7 and 8, respectively. A "float stitch" 62, or "miss" stitch, is defined as a stitch formed when a knitting needle holds an old loop and does not receive new yarn, thereby connecting two loops of the same course that are not in adjacent wales. A "tuck stitch" (FIG. 8) is defined as a knitting stitch that produces tuck or openwork effects by having certain needles hold more than one stitch at a time. A tuck stitch (FIG. 8) can be produced by raising the latch of a knitting needle far enough to receive a new yarn below the hook but without the old yarn loop(s) sliding below the latch, such that when the needle recedes, both new and old loops are retained. In embodiments of the present invention, float stitches 62 and tuck stitches can prevent runs in the direction of knitting.

Figure 9:
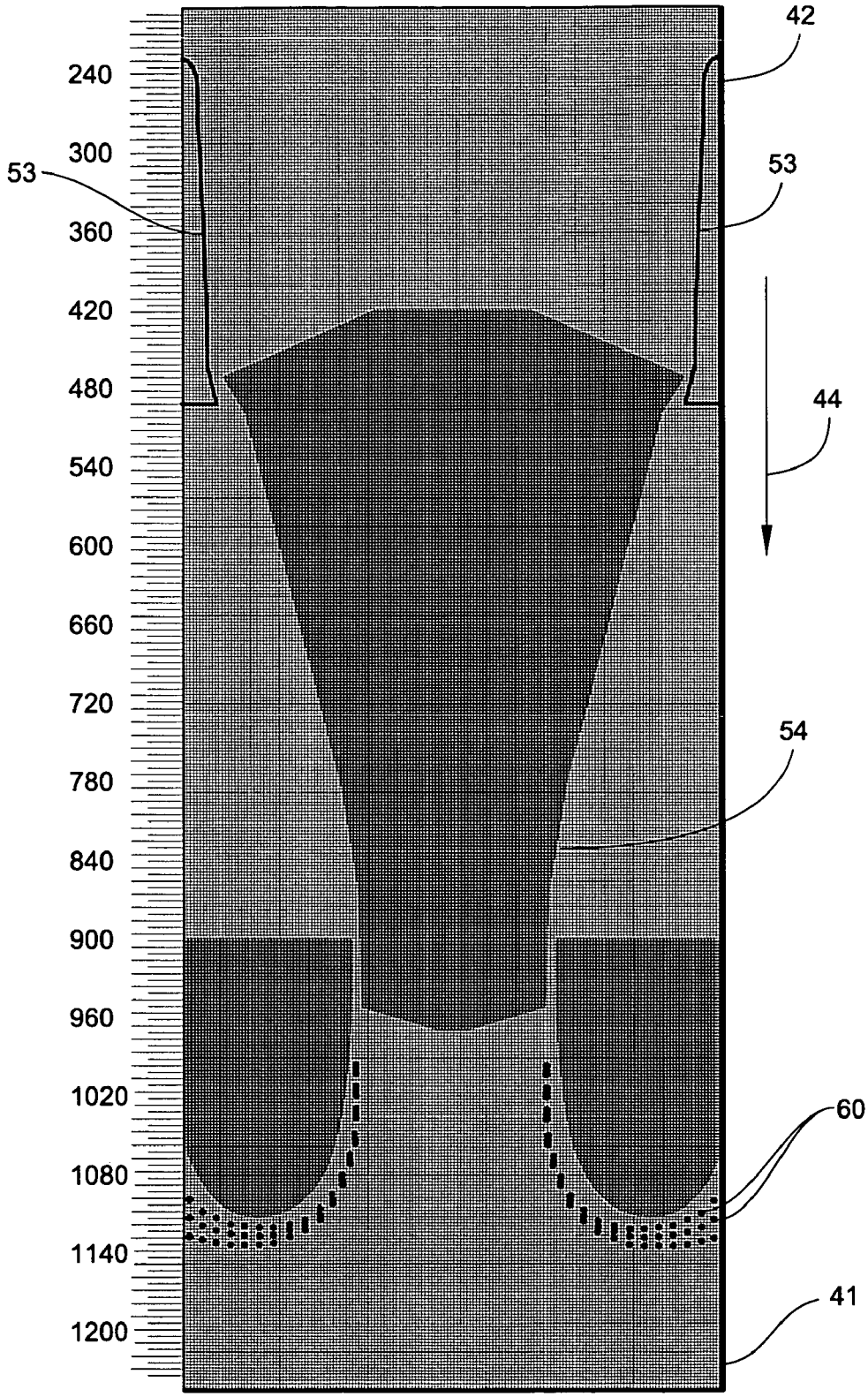
FIG. 9 is a diagrammatic view of a knit pattern for an underwear garment showing placement of run-prevention stitches adjacent front leg cut-out areas in the direction of knitting in an embodiment of the present invention.

FIG. 9 illustrates a knitting pattern for a panty garment blank 20 in an embodiment of the present invention. A panty garment blank 20 knit according to this pattern is knit 44 from back to front. The back leg cut-out lines 53 (which represent the back leg opening sew lines 45) are nearly parallel to the wales 51 such that a minimum number of wales 51, or no wales 51, are cut across when the back leg openings 25 are cut. As a result, loose ends and runs are prevented along the back leg openings 25. In automated panty manufacturing operations, cutting leg openings 25 and sewing seams and/or bands around the edges of the leg openings is a combined and nearly simultaneous step. The knitting pattern in FIG. 9 shows that run-prevention stitches 50 can be knit adjacent to the sewing marks 45 along the front leg opening cut-out lines 54 are to be cut. Run-prevention stitches 50 placed adjacent to front leg opening cut-out 54 areas prevent runs, in the direction of knitting 44, up the front 30 of the panty garment 10.

Embodiments of a method for preventing runs in panty garments 10 of the present invention can be utilized on conventional hosiery knitting machines, for example, a 400-needle, Lonati electronic circular knitting machine. In embodiments of the present invention, any knitting machine having sufficient needle selection capability so that sewing marks 45 can be programmed for placement at desired locations may be used.

Embodiments of a three-piece panty garment 10 of the present invention can include features for preventing ravels. In such embodiments, a panty garment 10 includes a means for preventing garment raveling by timing of yarn removal from a knitted finish end. In other embodiments, a panty garment 10 includes a means for preventing raveling by selecting a stitch that facilitates rolling of the garment edge. FIGS. 10–13 illustrate such embodiments.

Figure 10:
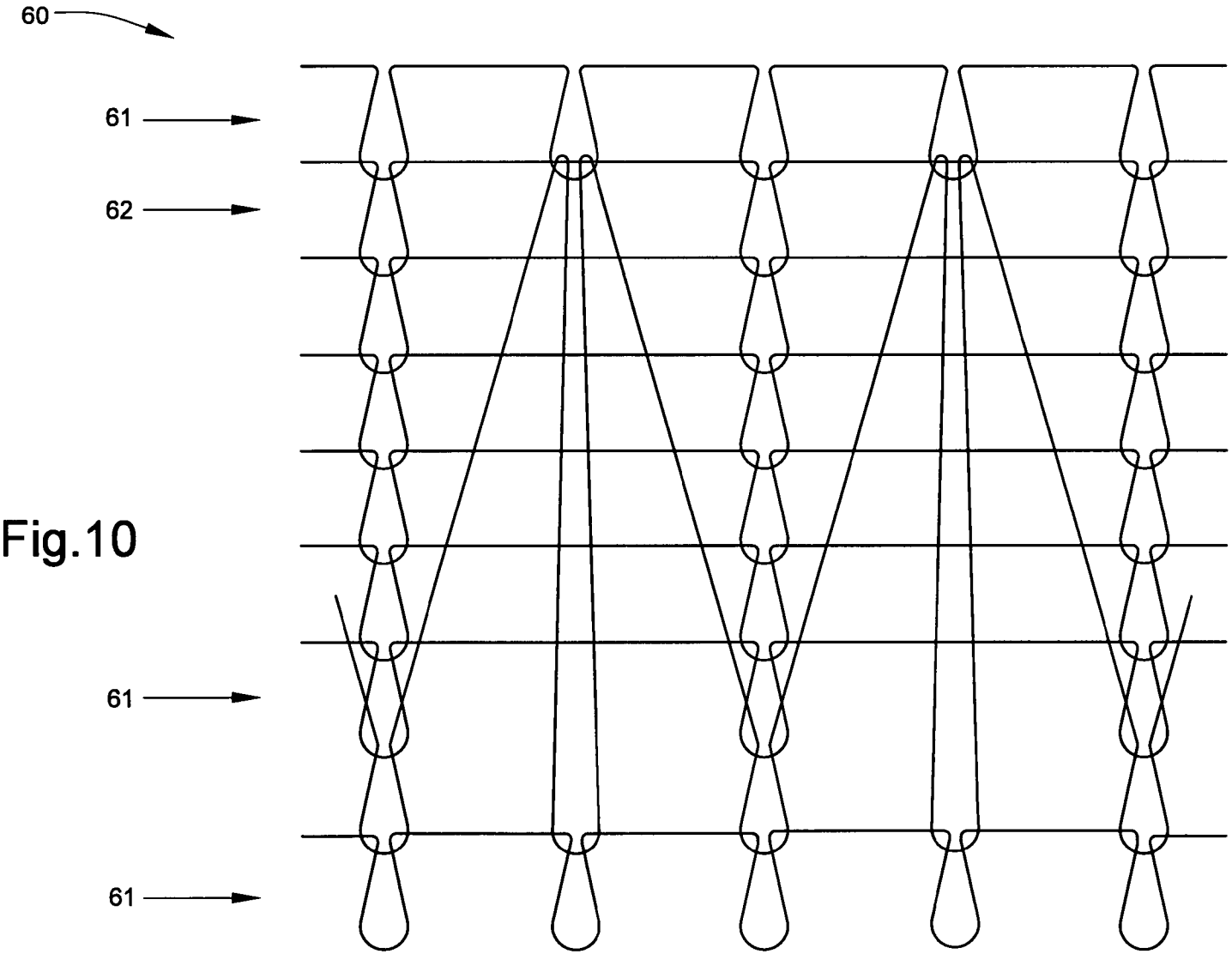
FIG. 10 is an illustration of a ravel prevention knitting pattern in an embodiment of the present invention.
Figure 11:
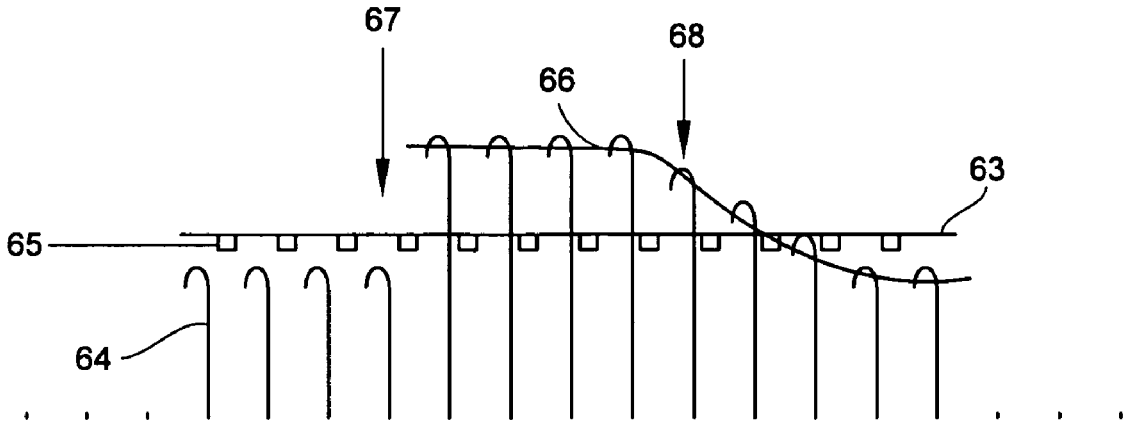
FIG. 11 is an illustration of knitting needles moving downward below the level of the sinkers and yarn on a knitting platform such that the yarn is pulled out of all needles in an embodiment of the present invention.
Figure 12:
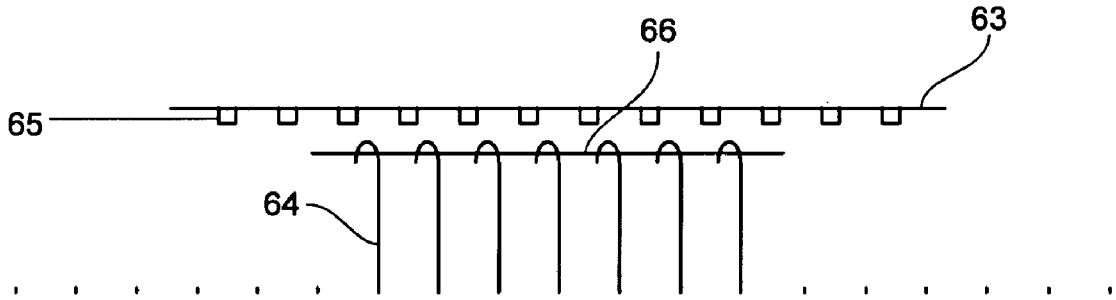
FIG. 12 is an illustration of all knitting needles down below the sinkers and thus no knitting occurring in a knitting cylinder revolution in an embodiment of the present invention.
Figure 13:
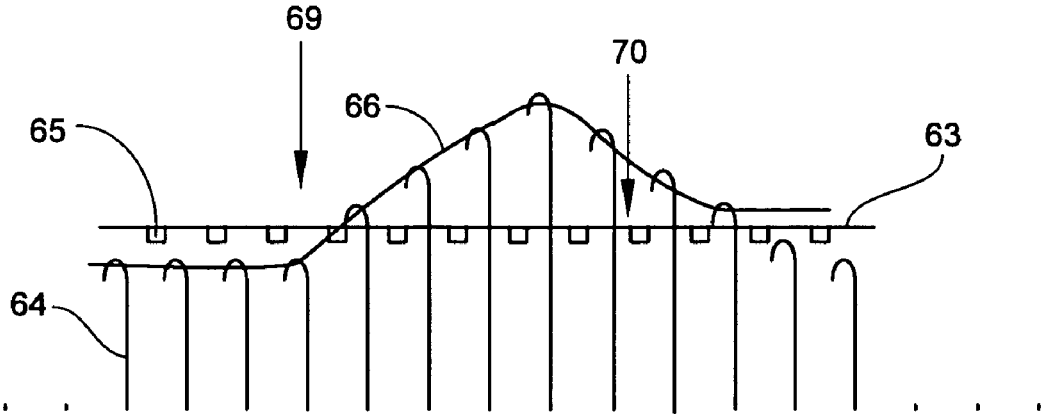
FIG. 13 is an illustration of all knitting needles returned to the up position above the knitting platform where they are maintained for a full revolution but without taking yarn in order to release the yarn from the finish end of the garment in an embodiment of the present invention.

In one such embodiment, as illustrated in FIG. 10, a method for preventing garment raveling of the present invention includes the following: In a four-feed circular knitting machine, full revolutions of the machine are made to knit full courses of jersey stitches 61 on all four feeds. Knitting of three feeds is discontinued at a designated point near the finish end of the panty garment blank 20. The remaining feed is programmed to knit a 1×1 positive float 62, in which a jersey stitch 61 is knit, followed by a float stitch 62, which is followed by a jersey stitch 61, and then another float stitch 62, in a repeating pattern. In embodiments, knitting can be performed on machines having a different number of feeds, for example, an eight-feed knitting machine. In any knitting machine, all feeds but one are de-selected at a designated point near the finish end of the panty garment blank 20 such that a single feed is used to knit a ravel prevention float stitch pattern 60. In embodiments, a ravel prevention positive float stitch pattern 60 can be a 1×1, 2×2, 3×1, or other selection float stitch 62 to promote rolling of the fabric finish end. As shown in FIG. 10, the 1×1 positive float stitch pattern 60 is knit for at least six revolutions of the knitting cylinder. The float stitches 62 shown in FIG. 10 are in exaggerated position to illustrate the knitting pattern 60. In panty garments knit by such a pattern 60, the loops of the float stitches 62 are pulled toward the previous course. In embodiments, the number of revolutions in which the 1×1 positive float stitch pattern 60 is knit can vary, for example, from six to ten revolutions. At least six revolutions has been found to be sufficient to decrease the tendency of the float stitch to "float" from its knitted position. The last course of the 1×1 positive float stitches pattern 60 is shown at the bottom of FIG. 10. Jersey stitches 61 are knit for a predetermined number of courses. At least two full courses of jersey stitches 61 are knit. Next, all needles 64 are pulled up for at least two full revolutions, so that two full courses of jersey stitches 61 are knit. In this manner, the last jersey knit course is connected by the float stitches 62 to previous jersey courses. Then, as shown in FIG. 11, all needles 64 are gradually dropped below the yarn level such that the yarn 66 is pulled out of all needles. (FIG. 11 shows only the last few needles 64 of the second jersey revolution in FIG. 10.) Needles 64 are pressed down by a downward moving 68 stitch cam. The knitting cylinder is rotated for one full revolution with all needles 64 down (below the knitting platform 63 and sinkers 65) and thus with no knitting occurring, as illustrated in FIG. 12. Finally, as shown in FIG. 13, all needles 64 are returned to the up position (actuated by upward movement 69 of the stitch cam). The needles 64 are maintained in the up position for a full revolution but without taking yarn 66 in order to shed, or release, the yarn 66 from the finish end of the garment blank 20 so that the garment blank 20 can exit the knitting machine cleanly.

In conventional knitting techniques, all needles 64 are not taken down below the knitting platform 63, sinkers 65, and yarn 66 level for a full revolution in the next-to-last revolution, but rather the needles 64 continue to pull yarn 66. As such, more "run-off" yarn "tails" are created, and the risk of raveling increases. In attempt to compensate for this increased risk for raveling thus created, operators often make the stitches in the last revolution tighter. In larger panty garments, it is often desirable to maintain the same degree of tightness, or compression, in the last course of knitting as in the remainder of courses in the garment. In embodiments of the present invention in which all needles 64 are dropped below the yarn 66 and no knitting occurs for at least a full revolution, the number of "run-off" yarn "tails" is significantly reduced. Therefore, such tightening in the last course is not necessary. Accordingly, embodiments of the present invention advantageously allow knitting of panty garment tubular blanks 20 without tightening the last knitted course, while maintaining an increased resistance to raveling on the garment finish end.

Embodiments of the present invention include methods of making a three-piece panty garment 10. For example, one illustrative method comprises knitting at least two tubular blanks 20 on a small-diameter circular knitting machine and making cut-outs 21 for leg openings at predetermined locations about the circumference of the tubular blanks 20. The tubular blanks 20 can be slit lengthwise to form a front panel 12 from one tubular blank 20 and two back panels 11, 13 from another tubular blank 20. A lengthwise front seam 29 extending between a waistband 26 and one of the leg openings 25 can be sewn to join each side 28 of the front panel 12 and one of the back panels 11, 13. Likewise, a lengthwise rear seam 33 extending between the waistband 26 and a crotch portion 27 can be sewn to join the two back panels 11, 13. A transverse rear crotch seam 37 extending between the leg openings 25 can be sewn to join the bottoms 34, 36 of the two back panels 11, 13 with the bottom 35 of the front panel 12. In this way, a panty garment 10 having larger sizes, for example, size 10, 12, and 14, can be made from tubular blanks 20 knit on a circular knitting machine designed for making pantyhose. Such a panty garment 10 formed from three "half-blanks" of a tubular blank 20 can comprise a girth 23 substantially three times the diameter 22 of the circular knitting machine knitting cylinder.

In an embodiment of a method, various sizes of the panty garment 10 can be made on the same circular knitting machine by tightening or loosening tension on yarn knit into the tubular blanks 20. A larger size panty garment 10 can be made by loosening the tension on yarn knit into the tubular blanks 20, and a smaller size panty garment 10 can be made by tightening the tension on yarn knit into the tubular blanks 20.

In another embodiment of a method, the bottom 35 of the front panel 12 can be slit lengthwise for a predetermined length to provide a Y-shaped crotch 38. The slit can be sewn along the crotch 38 to provide a panty garment crotch 38 configured similar to a crotch in conventional pantyhose.

In another embodiment of a method, the panty garment tubular blank 20 can be knit in a direction from the bottom 34, 35, 36 to the top. Leg opening cut-outs 21 can be made at an angle across wales 51. By knitting run prevention stitches 50 in predetermined courses downstream from the cut-outs 21, runs downstream from the cut-outs 21 can be prevented. Such run prevention stitches 50 may comprise float stitches 62 or tuck stitches.

Although the present invention has been described with reference to particular embodiments, it should be recognized that these embodiments are merely illustrative of the principles of the present invention. Those of ordinary skill in the art will appreciate that a three-piece panty garment of the present invention may be constructed and implemented in other ways and embodiments. Accordingly, the description herein should not be read as limiting the present invention, as other embodiments also fall within the scope of the present invention.

What is claimed is:

1. A panty garment, comprising:

a front panel and two back panels, each panel having a top and a bottom and formed from half of a tubular blank knit on a small-diameter circular knitting machine;

a crotch portion integrally knit with the front panel;

a waistband at the top of the front and back panels;

two leg openings;

a lengthwise front seam joining each side of the front panel and one of the back panels and extending between the waistband and one of the leg openings;

a lengthwise rear seam joining the two back panels and extending between the waistband and the crotch portion; and a rear crotch seam joining the bottoms of the two back panels with the bottom of the front panel and extending transversely between the leg openings.

2. The garment of claim 1, the circular knitting machine comprising a knitting cylinder having a diameter, and wherein the garment comprises a girth substantially three times the diameter of the knitting cylinder.

3. The garment of claim 1, wherein the front panel is formed from a first tubular blank and the two back panels are formed from a second tubular blank.

4. The garment of claim 3, wherein the two leg openings comprise cut-outs at predetermined locations about a circumference of the first and second tubular blanks.

5. The garment of claim 1, further comprising a means for making various sizes of the panty garment on the same circular knitting machine.

6. The garment of claim 5, wherein the means for making various sizes of the panty garment comprises tightening or loosening tension on yarn knit into the tubular blanks.

7. The garment of claim 5, wherein the various sizes of the panty garment comprise panty sizes 10, 12, and 14.

8. The garment of claim 1, wherein the waistband comprises an integrally knit turned waistband.

9. The garment of claim 1, wherein the waistband comprises a separate waistband sewn onto the garment after the front panel and the two back panels are sewn together.

10. The garment of claim 1, further comprising a thin band of elastic material sewn around edges of the leg openings.

11. The garment of claim 1, wherein the crotch comprises a Y-seam sewn about a lengthwise slit of the bottom of the front panel for a predetermined length.

12. The garment of claim 1, wherein the crotch comprises a stitch pattern different from a stitch pattern of the remainder of the panty garment.

13. The garment of claim 1, further comprising:

yarn knit into wales and courses;

a knit direction from the bottom to the top;

the two leg openings comprising cut-outs across wales; and run prevention stitches knit in predetermined courses downstream from the cut-outs, wherein runs are prevented downstream from the cut-outs in a front portion of the garment.

14. The garment of claim 13, wherein the run prevention stitches comprise float stitches.

15. The garment of claim 13, wherein the run prevention stitches comprise tuck stitches.

16. The garment of claim 1, wherein the two leg openings comprise cut-outs along an angle substantially parallel to knitted wales, wherein runs are prevented downstream from the cut-outs.

17. The garment of claim 1, the circular knitting machine comprising four feeds, further comprising an ending knitting pattern of the tubular blank comprising:

full courses of jersey stitches knit from all four feeds;

a positive float stitch knit in the only feed knitting for at least six revolutions; and no knitting in the next-to-last revolution.

18. A three-piece panty garment, comprising:

a front panel formed from half of a first tubular blank and two back panels formed from half of a second tubular blank, each tubular blank knit on a small-diameter circular knitting machine knitting cylinder having a diameter, and each panel having a top and a bottom;

a crotch portion integrally knit with the front panel;

a waistband at the top of the front and back panels;

two leg openings;

a lengthwise front seam joining each side of the front panel and one of the back panels and extending between the waistband and a topmost point of one of the leg openings;

a lengthwise rear seam joining the two back panels and extending between the waistband and the crotch portion; and a rear crotch seam joining the bottoms of the two back panels with the bottom of the front panel and extending transversely between the leg openings, wherein the garment comprises a girth substantially three times the diameter of the knitting cylinder.

19. A method of making a panty garment, comprising:

knitting at least two tubular blanks on a small-diameter circular knitting machine;

making cut-outs for leg openings at predetermined locations about a circumference of the tubular blanks;

slitting each of the tubular blanks lengthwise to form a front panel from one of the two tubular blanks and two back panels from the other tubular blank, each panel having a top and a bottom;

sewing a lengthwise front seam extending between a waistband and one of the leg openings to join each side of the front panel and one of the back panels;

sewing a lengthwise rear seam extending between the waistband and a crotch portion to join the two back panels; and sewing a rear crotch seam extending transversely between the leg openings to join the bottoms of the two back panels with the bottom of the front panel.

20. The method of claim 19, wherein the circular knitting machine comprising a knitting cylinder having a diameter, and wherein the garment comprises a girth substantially three times the diameter of the knitting cylinder.

21. The method of claim 19, further comprising making various sizes of the panty garment on the same circular knitting machine by tightening or loosening tension on yarn knit into the tubular blanks.

22. The method of claim 19, further comprising slitting the bottom of the front panel lengthwise for a predetermined length to provide a Y-shaped crotch and sewing the slit along the crotch.

23. The method of claim 19, further comprising:

knitting the garment in a direction from the bottom to the top;

making leg opening cut-outs across wales; and knitting run prevention stitches in predetermined courses downstream from the cut-outs.

24. The method of claim 23, wherein knitting run prevention stitches comprises knitting float stitches or tuck stitches.

25. The method of claim 19, further comprising making leg opening cut-outs along an angle substantially parallel to knitted wales, wherein runs are prevented downstream from the cut-outs.

26. The method of claim 19, further comprising:

knitting full courses of jersey stitches from all four feeds in a four-feed circular knitting machine;

discontinuing knitting of three feeds at a designated point near a finish end of the garment;

knitting a positive float stitch in the remaining feed for at least six revolutions; and taking down all needles below a yarn level for a full revolution in the next-to-last revolution so that no knitting occurs.

* * * * *